US007603071B2

(12) United States Patent
Sugiura et al.

(10) Patent No.: US 7,603,071 B2
(45) Date of Patent: Oct. 13, 2009

(54) LUBRICITY MAINTAINING IMAGE FORMING APPARATUS AND PROCESS CARTRIDGE

(75) Inventors: Kenji Sugiura, Yokohama (JP); Takuya Seshita, Hiratsuka (JP)

(73) Assignee: Ricoh Company Limited, Tokyo (JP)

( * ) Notice: Subject to any disclaimer, the term of this patent is extended or adjusted under 35 U.S.C. 154(b) by 146 days.

(21) Appl. No.: 11/424,777

(22) Filed: Jun. 16, 2006

(65) Prior Publication Data

US 2006/0285897 A1 Dec. 21, 2006

(30) Foreign Application Priority Data

Jun. 20, 2005 (JP) ..... 2005-179746

(51) Int. Cl.
*G03G 21/00* (2006.01)

(52) U.S. Cl. ..... 399/346

(58) Field of Classification Search ..... 399/343, 399/345, 346, 347, 350, 352, 353; 430/126.2
See application file for complete search history.

(56) References Cited

U.S. PATENT DOCUMENTS 5,898,022 A * 4/1999 Maples ..... 508/113
6,060,205 A * 5/2000 Takeichi et al. ..... 430/126.2
6,558,862 B2 * 5/2003 Kojima et al. ..... 430/58.05
2006/0285897 A1 12/2006 Sugiura et al.

FOREIGN PATENT DOCUMENTS

| | | |
|---|---|---|
| JP | 2001-68261 | 3/2001 |
| JP | 3478298 | 10/2003 |
| JP | 3719695 | 9/2005 |
| JP | 3750509 | 12/2005 |

OTHER PUBLICATIONS

U.S. Appl. No. 11/687,875, filed Mar. 19, 2007, Kojima et al.
U.S. Appl. No. 11/855,806, filed Sep. 14, 2007, Awamura et al.
U.S. Appl. No. 11/856,379, filed Sep. 17, 2007, Sawada et al.
U.S. Appl. No. 11/687,404, filed Mar. 16, 2007, Seshita et al.
U.S. Appl. No. 12/031,333, filed Feb. 14, 2008, Sugimoto et al.
U.S. Appl. No. 12/030,608, filed Feb. 13, 2008, Sugimoto et al.

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes an image bearer that carries a toner image and a lubricant supplying device that supplies lubricant to the surface of the image bearer. The lubricant supplying device is provided in the image forming apparatus and includes a lubricant block and a brush roller. The brush roller shaves and supplies the lubricant from the lubricant block to the image bearer via the brush roller. The lubricant only includes a mixture of boron nitride and fatty acid metallic salt. The lubricant includes from 10 to 80 percent volume of the boron nitride.

17 Claims, 6 Drawing Sheets

| CONDITIONS | INITIAL FRICTION COEFFICIENT | FRICTION COEFFICIENT AFTER 1000 SHEETS ARE PRINTED |
|---|---|---|
| 1. ZINC STEARATE | 0.10 | 0.55 |
| 2. BORON NITRIDE | 0.25 | 0.35 |
| 3.ZINC STEARATE & BORON NITRIDE | 0.10 | 0.30 |

FIG. 11

| CONDITIONS | INITIAL FRICTION COEFFICIENT | FRICTION COEFFICIENT AFTER 1000 SHEETS ARE PRINTED |
|---|---|---|
| 1. ZINC STEARATE | 0.10 | 0.55 |
| 2. BORON NITRIDE | 0.25 | 0.35 |
| 3.ZINC STEARATE & BORON NITRIDE | 0.10 | 0.30 |

LUBRICITY MAINTAINING IMAGE FORMING APPARATUS AND PROCESS CARTRIDGE

CROSS REFERENCE TO THE RELATED APPLICATION

This application claims priority under 35 USC § 119 to Japanese Patent Application No. 2005-179746 filed on Jun. 20, 2005, the entire contents of which are herein incorporated by reference.

BACKGROUND OF THE INVENTION

1. Field of the Invention

The present invention relates to an image forming apparatus including an image bearer, on which a toner image is formed, and a lubricant supplying device that supplies lubricant to the surface of the image bearer. The present invention also relates to a process cartridge, which is detachably attached to a body of the image forming apparatus while mounting an image bearer, on which a toner image is formed, and a lubricant supplying device that supplies lubricant to the surface of the image bearer.

2. Discussion of the Background Art

The above-mentioned image forming apparatus such as an electronic copier, a printer, a facsimile, a complex machine combining these, etc., has been well known as discussed in Japanese Patent Application Laid Open No. 2002-91232. The image bearer includes a photoconductive member or an intermediate transfer member that receives transfer of a toner image formed on the photoconductive member. When the lubricant is coated on the surface of the image bearer, a friction coefficient of the surface is decreased and a friction caused between the surface of the image bearer and a member contacting the image bearer can be decreased. Thus, the friction on the image bearer surface can be suppressed, thereby a life of the image bearer can be prolonged.

As a lubricant, fatty acid metallic salt, such as zinc stearate, etc., is conventionally widely used. However, a characteristic of the lubricant apparently changes under the influence of discharge in the vicinity of the image bearer, thereby lubricity is relatively quickly loosed. For example, when a photoconductive member is employed as an image bearer, discharge is created between a discharge apparatus and the photoconductive member so as to charge the photoconductive member with a prescribed polarity. However, since the lubricant coated on the surface of the photoconductive member deteriorates due to the discharge. When an intermediate transfer member is employed as an image bearer, discharge is also created between a transfer apparatus and the intermediate transfer member so as to transfer a toner image formed on the intermediate transfer member to a transfer medium. However, since the lubricant coated on the intermediate transfer member surface also deteriorates due to the discharge.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 11 illustrates a table showing an exemplary experimental resultant.

SUMMARY

Accordingly, an object of the present invention is to address and resolve such and other problems and provide a new and novel image forming apparatus. Such a new and novel image forming apparatus comprising: an image bearer configured to carry a toner image; and a lubricant supplying device configured to supply lubricant to the surface of the image bearer; wherein said lubricant at least includes a mixture of boron nitride and fatty acid metallic salt.

In another embodiment, the image forming apparatus further comprises a membrane forming device configured to frictionally apply the lubricant to the surface of the image bearer and form a lubricant membrane on the surface.

In another embodiment, the lubricant supplying device at least intermittently supplies the lubricant when the image bearer rotates.

In yet another embodiment, a process cartridge detachable from an image forming apparatus body includes an image bearer that allows formation of a toner image, and a lubricant supplying device that supplies lubricant to the surface of the image bearer. The lubricant at least includes a mixture of boron nitride and fatty acid metallic salt.

In yet another embodiment, the process cartridge further includes a membrane forming device that frictionally applies the lubricant and forms a lubricant membrane on the surface of the image bearer.

In yet another embodiment, the lubricant supplying device at least intermittently supplies the lubricant when the image bearer rotates.

DESCRIPTION OF THE PREFERRED EMBODIMENTS

Figure 1:
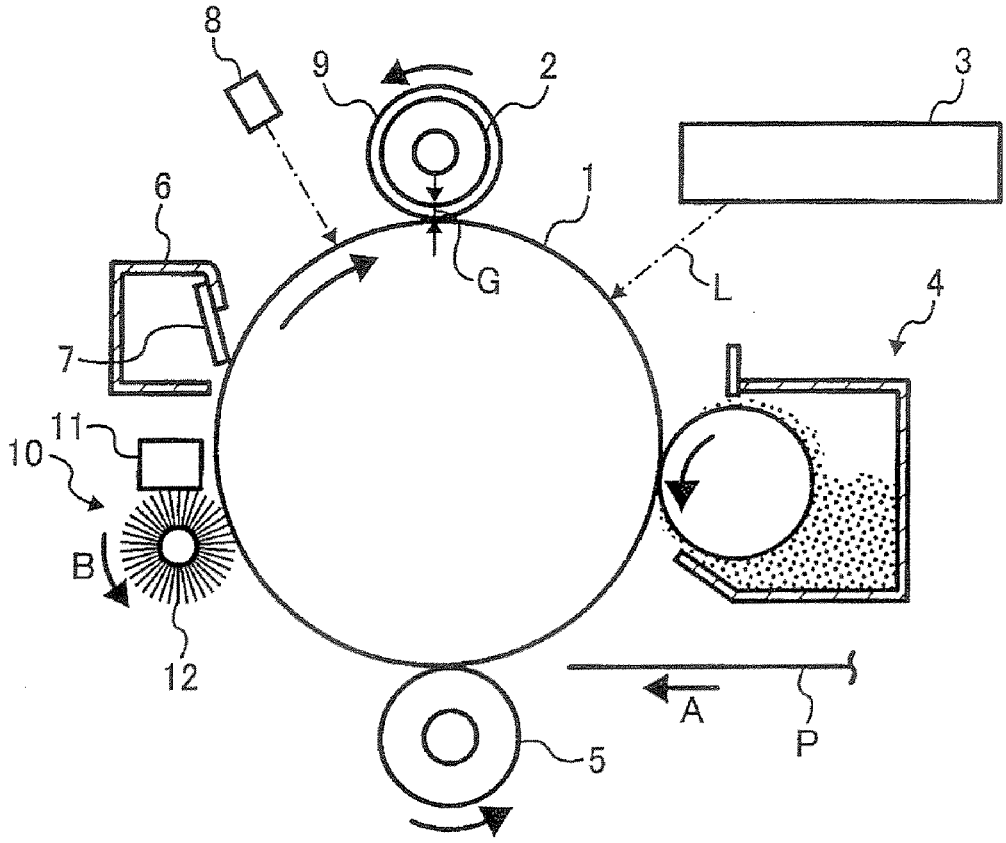
FIG. 1 illustrates an exemplary image forming apparatus.

Referring now to the drawing, wherein like reference numerals designate identical or corresponding parts throughout several views, in particular, in FIG. 1, the image forming apparatus includes an image bearer 1 having a drum shape (not shown). The image bearer 1 is driven clockwise when an image is formed.

The image bearer 1 is charged to have a prescribed polarity by a discharge device such as a discharge roller 2. A laser light L is modulated and emitted from an exposure device 3 to a discharge surface, thereby a latent image is formed on the image bearer. The latent image is visualized by powder toner when passing through a developing device 4.

A sheet feeding device, not shown, feeds a transfer member P of a printing sheet in a direction shown by an arrow A. The transfer member P is conveyed to a section between the image bearer 1 and a transfer device such as a transfer roller 5 opposing the image bearer 1. In this instance, a toner image on the image bearer 1 is transferred onto the transfer member P by an operation of the transfer roller 5. A cleaning device 6 removes toner remaining on the image bearer 1 after toner image transfer. The cleaning device 6 includes a cleaning member having a cleaning blade 7 pressure-contracting the image bearer 1. Thus, the cleaning blade 7 removes transfer remaining toner. Then, a charge removing lamp 8 emits light to the surface of the image bearer and initializes a surface voltage of the image bearer 1.

The transfer member P separated from the image bearer 1 passes through a fixing device, not shown, so that the toner image is fixed onto the transfer member P by actions of heat and pressure. The transfer member P having passed through the fixing device is ejected onto an ejection tray, not shown.

Figure 2:
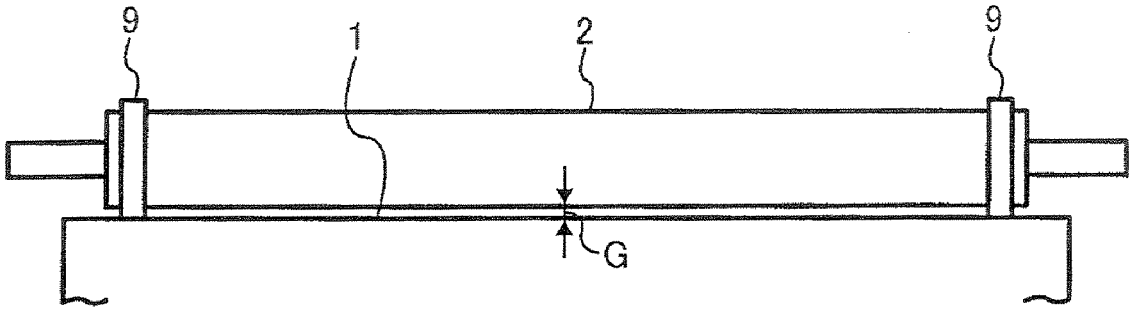
FIG. 2 illustrates an exemplary discharge roller and an exemplary image bearer.

A pair of spacers 9 formed from a tape are adhered to the longitudinal ends of the discharge roller 2 as shown in FIG. 2. The respective spacers 9 pressure contact the image bearer 1 to form a gap G between the charge roller 2 and the image bearer 1. A discharge voltage is applied to the discharge roller 2 so as to create discharge between the charge roller 2 and the image bearer 1. Thereby, the image bearer 1 is discharged with a prescribed polarity. Similarly, a transfer voltage opposite to a toner discharge polarity of a toner image on the image bearer is applied to the transfer roller 5. Thus, discharge occurs between the transfer roller 5 and the image bearer 1. Then, the toner image on the image bearer 1 is transferred onto the transfer member P.

The image forming apparatus of FIG. 1 includes a lubricant supplying device 10 that supplies lubricant to the surface of the image bearer beside the image bearer that carries a toner image as mentioned earlier. The lubricant supplying device 10 includes a lubricant block 11 molded in a bar state and a brush roller 12 rotated in a direction shown by an arrow B while contacting the surfaces of the lubricant block 11 and the image bearer 1. As the brush roller 12 rotates, the lubricant of the lubricant block 11 is scraped away little by little. The lubricant adhering to the brush of the brush roller 12 is supplied to the surface of the image bearer 1 in the course of the rotation. The lubricant block 11 can be formed in a roller state to rotate and sliding contacts the brush roller 12.

Powder state lubricant supplied as mentioned above is frictionally applied by the cleaning blade 7 to the surface of the image bearer, thereby a membrane is formed thereon. In the image forming apparatus of FIG. 1, the cleaning blade 7 frictionally applies the supplied lubricant to the surface of the image bearer, thereby functioning as a membrane forming device that forms a lubricant membrane on the surface of the image bearer. Thus, by forming a lubricant membrane on the surface of the image bearer, a friction coefficient on the surface of the image bearer is decreased, and a friction force created between the cleaning blade 7 and the surface of the image bearer can be decreased. As a result, a life of the image bearer 1 can be prolonged.

If the lubricant is simply supplied to the surface of the image bearer, it can't show lubricity, because of staying in a powder state on the image bearer. Thus, the lubricant never shows such lubricity in such a condition. In order to exert lubricity of the lubricant, a powder state lubricant need to be frictionally applied to the surface of the image bearer so as to form a membrane of the lubricant. In the example of FIG. 1, since the cleaning blade 7 frictionally applies the lubricant supplied to the surface of the image bearer 1, a membrane of the lubricant can be formed thereon and lubricity of the lubricant can be increased as mentioned above.

Although the lubricant block 11 in the solid bar state is used in the lubricant supplying device 10 of FIG. 1, a powder lubricant can be used as mentioned later. To solidify the lubricant in a bar state, a powder lubricant is molded under pressure. Otherwise, a powder lubricant is heated and melted. Then, it is poured into the mold and cooled. Thereby, a lubricant block is molded. In any way, a composition of boron nitride and fatty acid metallic salt is used as a lubricant.

When the boron nitride is used as a lubricant, the lubricant supplied to the image bearer and made into a membrane hardly quickly deteriorates even if discharge occurs when the discharge and transfer rollers are driven. This is because, a characteristic of the boron nitride is hardly changed by the discharge, and accordingly lubricity is relatively hardly lost in comparison with that of the other lubricants. In addition, the boron nitride also can prevent the image bearer from being oxidized and escaping as vapor.

However, when a lubricant only including the boron nitride is used, the lubricant supplied to the surface of the image bearer does not get across the entire surface of the image bearer, and is likely impossible to uniformly form a lubricant membrane over the entire surface of the image bearer. Then, as mentioned above, the lubricant used in the lubricant supplying device 10 includes fatty acid metallic salt beside the boron nitride. Thus, the lubricant membrane can be efficiently entirely formed over the surface of the image bearer, and maintain high lubricity for a long time. In other words, by using a lubricant including the fatty acid metallic salt, the lubricant membrane can be efficiently entirely formed over the surface of the image bearer.

Further, as a crystal structure of the boron nitride, a low pressure phase structure (h-BN) similar to a hexagonal system graphite type structure, a hexagonal system zinc blend type structure (C-BN), and a hexagonal system Wurtzite type structure (W-BN) are exemplified. Among these structural boron nitrides, a hexagonal system low pressure phase similar to a hexagonal system graphite type structure has a lamellar structure. Since such a hexagonal system low pressure phase boron nitride is material having a cleavage performance in a direction perpendicular to a layer, such a lubricant maintains a friction coefficient of less than about 0.2 to about 400 degree Celsius and has a high lubricity. Further, it is especially hardly affected by discharge. Accordingly, a hexagonal system low pressure phase boron nitride is especially preferable. Specifically, when a lubricant including such a boron nitride is coated and made into a membrane on the surface of the image bearer, deterioration thereof can be efficiently avoided and maintain lubricity even if the membrane passes through the discharge roller 2 and receives influence of the discharge.

As a fatty acid metallic salt, a substance having a lamella crystal structure, such as fluorocarbon resin, zinc stearate, calcium stearate, barium stearate, aluminum stearate, magnesium stearate, etc., or a substance, such as lauroyl lysine, mono-cetyl phosphate ester natrium zinc salt, lauroyl taurine calcium, est., can be used. Further, beside these fatty acid metallic salt and boron nitride, liquid material, such as silicone oil, fluorocarbon oil, natural wax, etc., and gas material can be added using an external addition manner.

Among the above-mentioned fatty acid metallic salt, the zinc stearate is especially preferable. This is because, the zinc stearate has excellent extensibility on an image bearer, and low hygroscopicity, and hardly looses lubricity even when humidity changes.

A content of boron nitride in a lubricant can be optionally set. However, it preferably ranges from about 10 to 80 volume percent. When the content lowers the range, improvement of lubricity with the boron nitride can't be expected, or deterioration of the lubricant caused by discharge can't be improved. In contrast, when the content exceeds the above-mentioned range, a membrane of the lubricant can't be efficiently formed over the surface of the image bearer.

To solidify the above-mentioned lubricant component material in a bar state as mentioned earlier, binder is added upon need to the material component when molding thereof.

In the lubricant supplying device 10 of FIG. 1, the lubricant coating member including a brush roller 12 is used. However, a lubricant can be coated on the surface of the image bearer via a lubricant coating member, such as a sponge pad, an elastic roller, etc. Otherwise, a lubricant block or a powder state lubricant can contact the surface of the image bearer to directly supply the lubricant thereto.

Now, another lubricant supplying method using a lubricant supplying device that supplies lubricant to a surface of an image bearer is specifically described.

Figure 3:
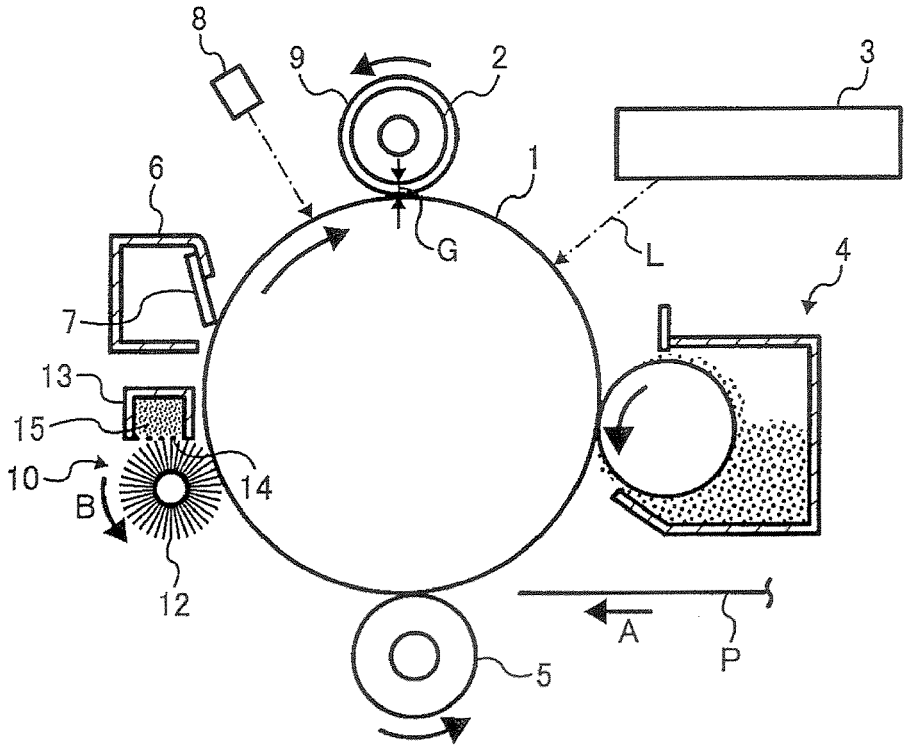
FIG. 3 illustrates another exemplary image forming apparatus.

In the image forming apparatus of FIG. 3, the lubricant supplying device 10 includes a container 13 instead of the lubricant block. The bottom of the container 13 is formed from a grid member 14 having a plurality of mesh like openings. A powder lubricant 15 including boron nitride and fatty acid metallic salt is contained in the container 13. A brush roller 12 is arranged contacting the grid member 14 thereof and the surface of the image bearer. By rotating the brush roller 12, the lubricant 15 in the container 13 is partially supplied to the brush roller 12 though the mesh like openings, thereby being supplied to the surface of the image bearer. The powder lubricant thus supplied to the surface of the image bearer is frictionally applied to the surface of the image bearer by the cleaning blade 7 of the cleaning device 6, thereby a lubricant membrane is formed on the surface of the image bearer. The remaining configuration of the image forming apparatus of FIG. 3 is similar to those in FIGS. 1 and 2.

Figure 4:
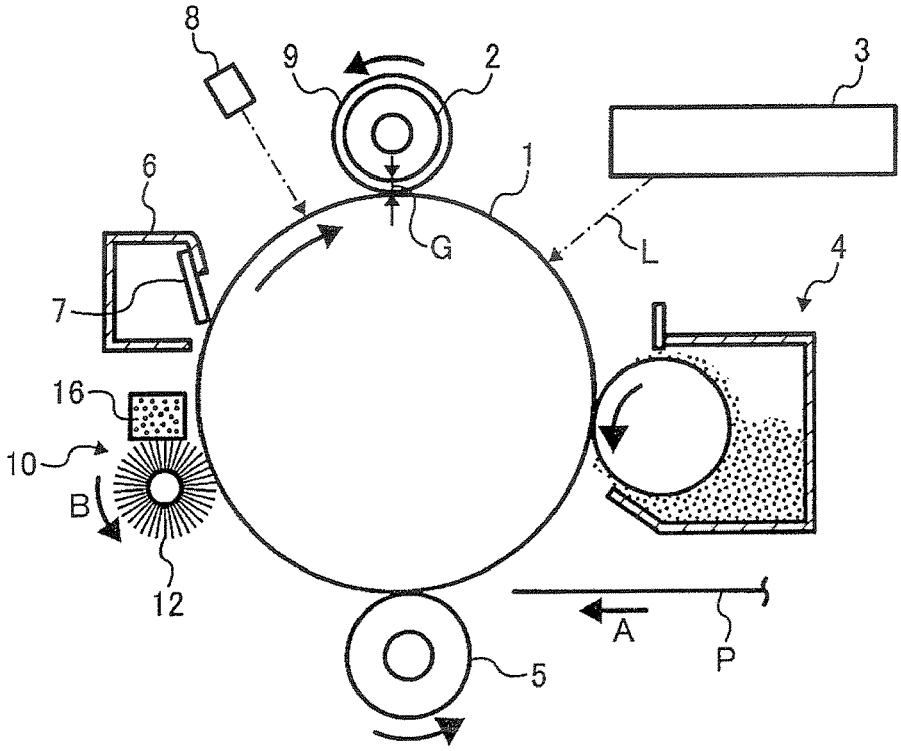
FIG. 4 illustrates still another exemplary image forming apparatus.

The lubricant supplying device 10 of FIG. 4 includes a sponge member 16 maintaining powder lubricant instead of the container 13 of FIG. 3. When a brush roller 12 rotates, the lubricant maintained by the sponge member 16 is supplied to the surface of the image bearer via the brush roller 12. The sponge member 16 can be formed in a roller state to be rotated and used. The remaining configuration of the image forming apparatus of FIG. 4 is similar to that in FIG. 3.

Figure 5:
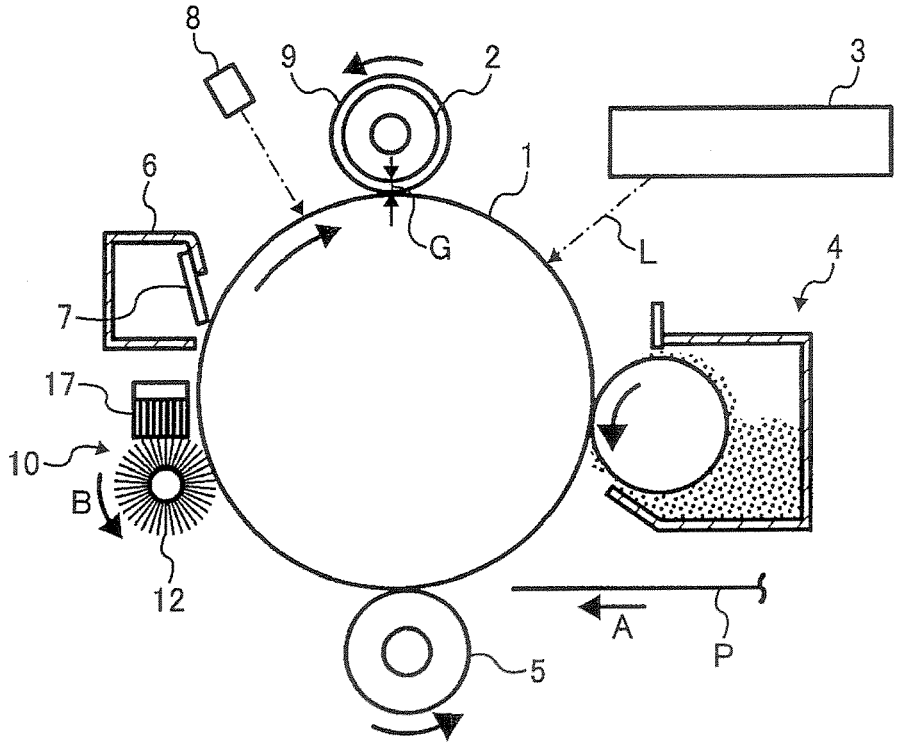
FIG. 5 illustrates yet another exemplary image forming apparatus.

The lubricant supplying device 10 of FIG. 5 includes a brush member 17 that includes a brush made of porous textiles that maintains powder lubricant instead of the container 13 of FIG. 3. The lubricant maintained by textiles of the brush is supplied to the surface of the image bearer via the brush roller 12 during rotation thereof. The brush member 17 can be formed in a roller state to be rotated and used. The remaining configuration of the image forming apparatus of FIG. 5 is similar to that in FIG. 3.

Figure 6:
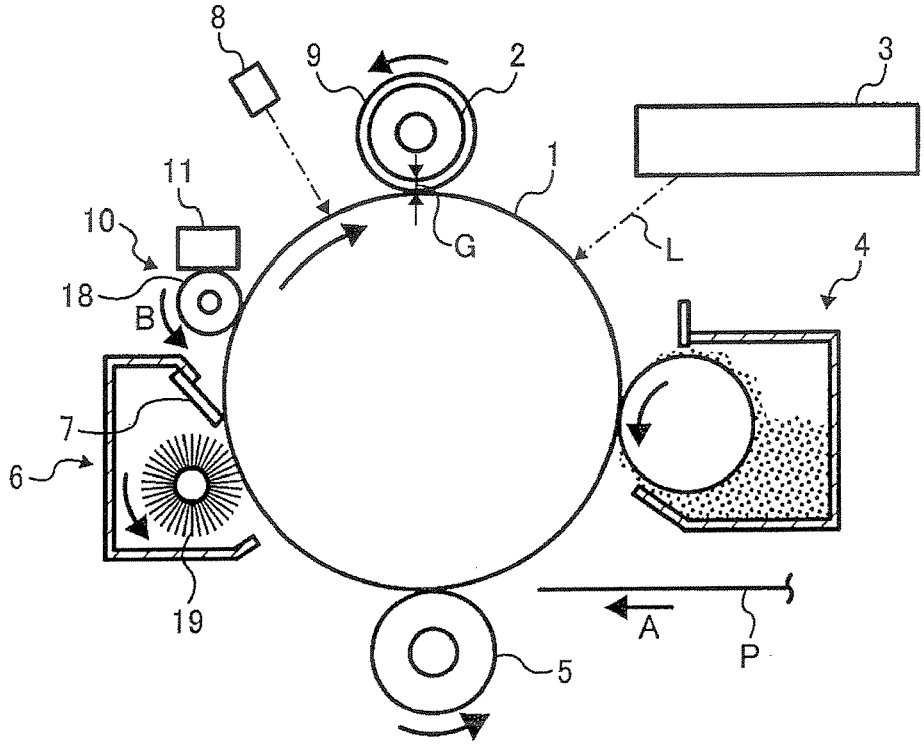
FIG. 6 illustrates still another exemplary image forming apparatus.

The lubricant supplying device 10 of FIG. 6 includes an elastic roller 18 arranged downstream of the cleaning device 6 and upstream of the charge roller 2 in a rotational direction of the image bearer 1 instead of the brush roller 12 of FIG. 1. When the elastic roller 18 rotates in a direction shown by an arrow B, a lubricant is shaved and supplied to the surface of the image bearer from the lubricant block 11. At the same time, the elastic roller 18 frictionally applies the powder lubricant to the surface of the image bearer, thereby a lubricant membrane is formed thereon. Thus, the elastic roller 18 serves as a lubricant coating device and a membrane forming device in this example.

As an elastic roller 18, a rubber roller, a urethane roller, and an elastomer roller can be employed. A roughness Rz of the surface of the roller is not more than 30 micrometer, preferably not more than 10 micrometer, more preferably not more than 2 micrometer. A roller hardness is enough if a nip can be formed by pressure contact between the roller and the surface of the image bearer. The hardness is preferably from 40 to 80 degree, preferably 40 to 65 degree, more preferably 50 to 60 degree in JIS-A hardness.

Further, as an elastic roller 18, a tube coat roller can be employed. For example, a urethane roller covered by a tube, or a brush roller covered by a tube can be employed. As a tube, polyimide or fluorine type seamless tube having thickness of 50 to 1000 micrometer can be employed. As a tube material, a fluorine type PVDF or the like is preferably used.

The better the tube the smoother the surface thereof. Specifically, the surface roughness Rz is preferably not more than 1 micrometer, preferably not more than 0.5 micrometer.

Since the lubricant supplying device 10 coats the surface of the image bearer with the lubricant before the cleaning device 6 removes transfer toner remaining thereon in the image forming apparatus of FIGS. 1 to 5, unevenness likely occurs in coating the lubricant due to disturbance of the transfer toner remaining on the image bearer. However, since the lubricant supplying device 10 coats the surface of the image bearer with the lubricant after the cleaning device 6 removes transfer toner remaining thereon in the image forming apparatus of FIG. 6, unevenness of coating with the lubricant can be suppressed. Further, since the lubricant supplying device 10 coats the surface of the image bearer upstream of the discharge roller 2 in a rotational direction of the image bearer 1 with the lubricant, deterioration of the image bearer 1 due to discharge can be suppressed. A cleaning member including a cleaning brush 19 beside the cleaning blade 7 is employed in the cleaning device 6 of FIG. 6. The remaining configuration of the image forming apparatus of FIG. 6 is similar to that in FIG. 1.

Figure 7:
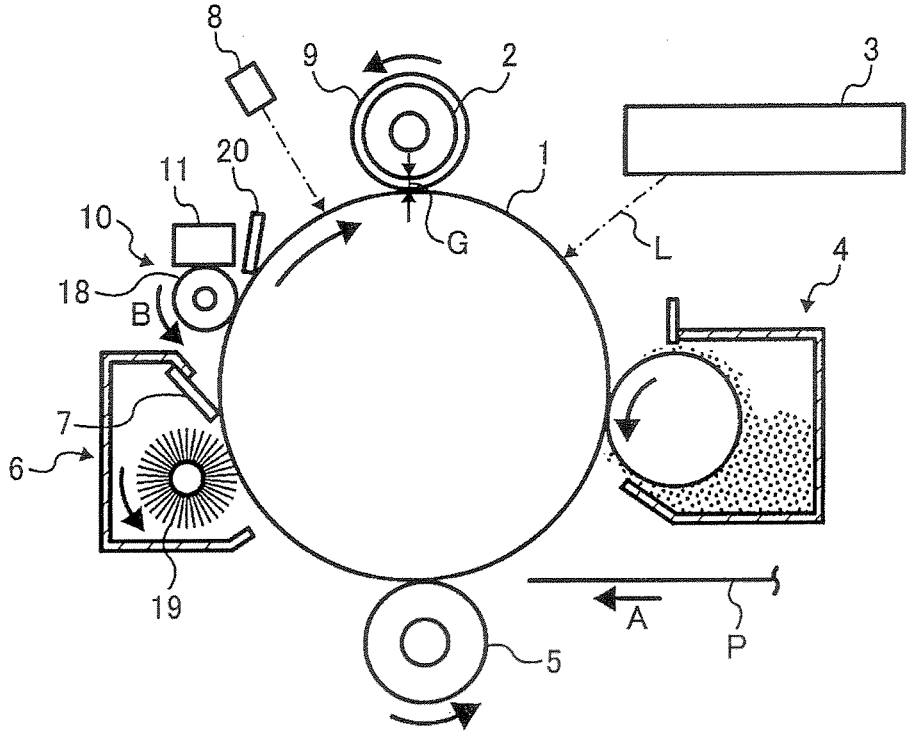
FIG. 7 illustrates yet another exemplary image forming apparatus.

Further, the elastic blade 20 pressure contacts the surface of the image bearer upstream of the discharge roller 2 and downstream of the lubricant supplying device 10 in a rotational direction of the image bearer 1 in the image forming apparatus of FIG. 7. Thus, the lubricant supplied to the surface of the image bearer by the lubricant supplying device 10 can be more credibly made into a membrane by the elastic blade 20. A membrane forming device includes an elastic roller 18 and an elastic blade 20 in the image forming apparatus of FIG. 7. The remaining configuration of the image forming apparatus of FIG. 7 is similar to that in FIG. 6.

Figure 8:
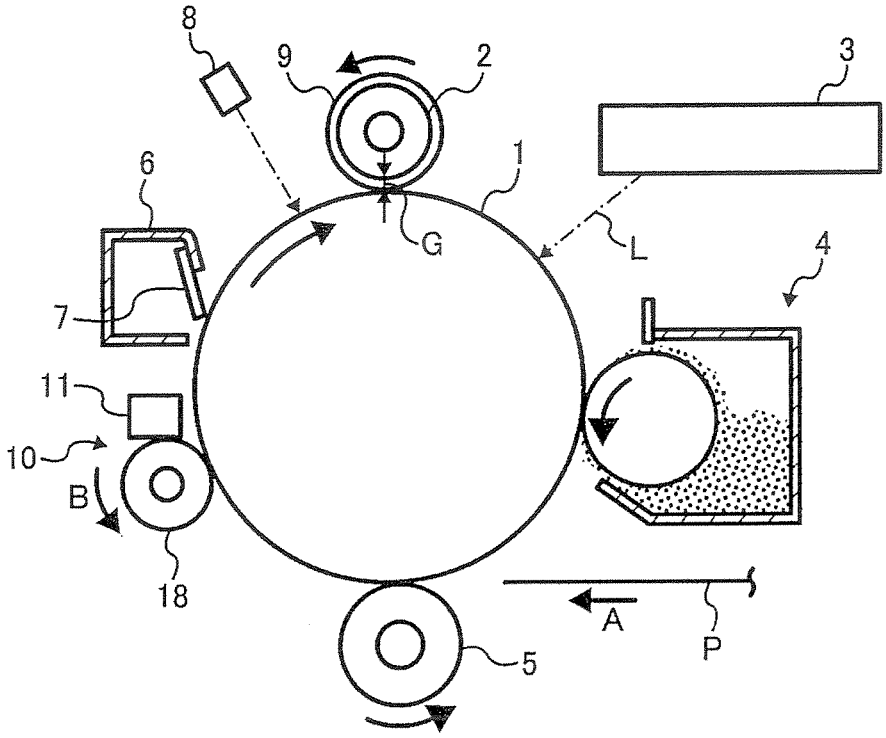
FIG. 8 illustrates still another exemplary image forming apparatus.

A lubricant supplying device 10 of FIG. 8 has substantially the same configuration as that in FIG. 6. However, the lubricant supplying device 10 is arranged upstream of the cleaning device 6 in a rotational direction of the image bearer 1. The elastic roller 18 and the cleaning blade 7 cooperatively frictionally applies the supplied powder lubricant to the surface of the image bearer, thereby a membrane is formed thereon also in this image forming apparatus. Specifically, a membrane forming device is thus includes the elastic roller 18 and the cleaning blade 7. The remaining configuration of the image forming apparatus of FIG. 8 is similar to that in FIG. 1.

Figure 9:
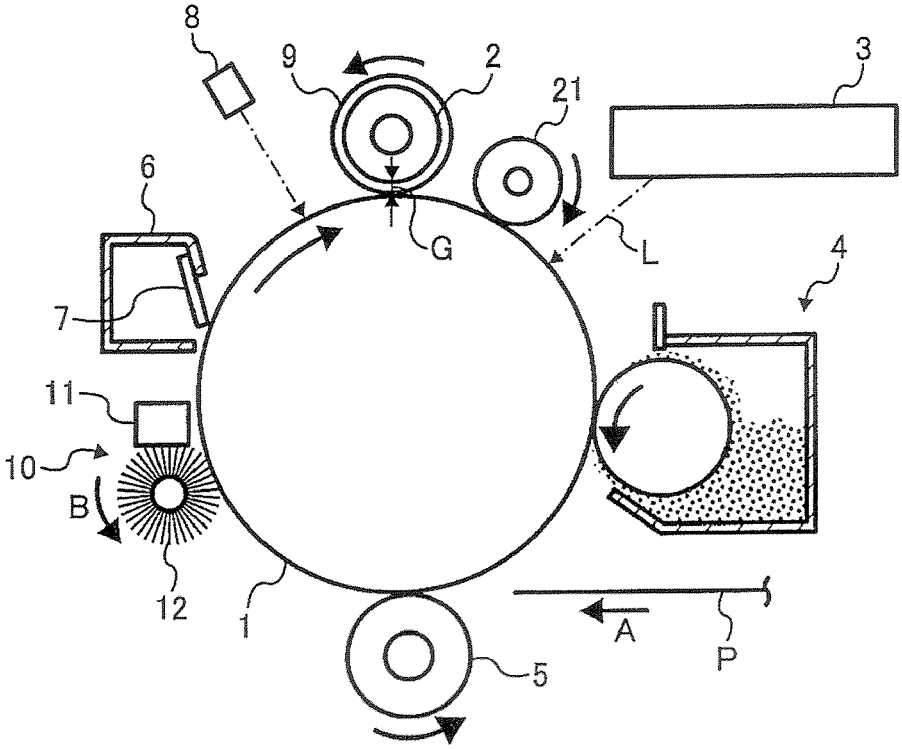
FIG. 9 illustrates yet another exemplary image forming apparatus.

Further, the elastic roller 21 pressure contacts the surface of the image bearer downstream of the discharge roller 2 in a rotational direction of the image bearer 1 in the image forming apparatus of FIG. 9. The elastic roller 21 functions as a membrane forming device that frictionally applies the lubricant supplied to the image bearer to the surface of the image bearer. Specifically, although the lubricant supplied to the surface of the image bearer by the lubricant supplying device 10 partially deteriorates when passing through the discharge roller 2 due to a discharge operation, the elastic roller 21 removes the deteriorated lubricant. Thus, lubricity of the image bearer 1 is more improved. A blade can be used instead of the elastic roller. The remaining configuration of the image forming apparatus of FIG. 9 is similar to that in FIG. 1.

Figure 10:
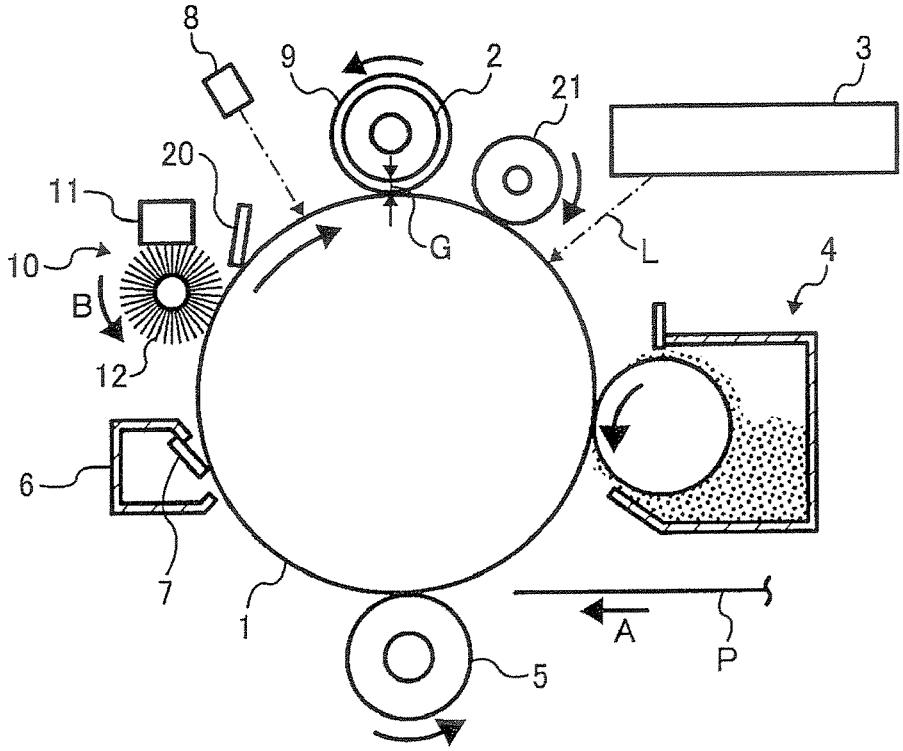
FIG. 10 illustrates yet another exemplary image forming apparatus.

In the image forming apparatus of FIG. 10, the lubricant supplying device 10 is arranged downstream of the cleaning device 6, and the elastic blade 20 is arranged downstream of the lubricant supplying device 10 both in the rotational direction of the image bearer 1. Further, the elastic blade 20 is enabled to frictionally apply the lubricant supplied to the image bearer 1 by the lubricant supplying device 10 to the surface of the image bearer 1. The remaining configuration of the image forming apparatus of FIG. 10 is similar to that in FIG. 9.

The cleaning blade 7 or the elastic blade 20 frictionally applies the lubricant to the surface of the image bearer in the image forming apparatus in FIGS. 1 to 10, the elastic blade can frictionally apply not only in a counter direction but also in a trailing direction. Further, a leading corner of the elastic blade that pressure contacts the image bearer can be cut away so as to suppress uneven contact of the elastic blade to the surface of the image bearer. Further, if only an elastic blade made of rubber is employed, a bending force is weak and the elastic blade likely unevenly contacts the surface of the image bearer. Then, a rigid member such as a metal, etc., can be laminated with the elastic blade so as to intensify the entire bending force in order to suppress uneven contact of the elastic blade with the surface of the image bearer.

Further, the lubricant supplying device 10 can be enabled to always intermittently supply the lubricant to the surface of the image bearer when the image bearer 1 rotates. When the lubricant is intermittently supplied to the surface of the image bearer, the lubricant supplying device 10 can be detachably supported in relation to the surface of the image bearer. Specifically, a solenoid or an actuator can detachably support the lubricant supplying device 10. Otherwise, when the lubricant is not supplied to the image bearer 1, a lubricant coating member including a brush roller 12 or an elastic roller 18 is enabled to stop rotation. Specifically, the lubricant supplying device supplies the lubricant to the surface of the image bearer per image formation of 50 to 200 times.

Further, when ambient temperature is relatively low, an amount of the lubricant supplied from the lubricant supplying device 10 to the image bearer 1 excessively increases. As a result, the lubricant adheres to the discharge roller 2 and likely causes unstable discharge. Then, pressure of the lubricant coating member such as a brush roller 12 against the surface of the image bearer can be decreased so as to decrease the amount of lubricant supplied to the surface of the image bearer.

Further, when an image forming apparatus is operated after long time interval, the image bearer tends to be oxidized due to discharge. Thus, an interval of the image forming apparatus is detected, and an amount of the lubricant to be supplied to the image bearer 21 is increased when it is relatively long.

Further, by detecting a shaft torque of the image bearer, an amount of the lubricant on the surface of the image bearer is detected. Then, the amount of lubricant to be supplied to the image bearer can be increased in accordance with the amount. Further, when a spacer 9 is attached to a discharge roller 2, and contacts the image bearer like an image forming apparatus of FIG. 1, it is advantageous to supply a lot of lubricant between the spacer 9 and the image bearer so as to decrease friction caused therebetween.

New, an exemplary experiment for investigating lubricity of an image bearer is described. An exemplary experiment apparatus and several conditions are described below.

Copier Machine: IPSio color 8200 Remodel Machine (full-color printer of direct transfer system);

Discharge Device: Hard type Discharge Roller not contacting Image bearer;

Bias Applied to Discharge roller: AC component; Vpp3.0 kv, Frequency; 4 kHz, DC component; −700v;

Environment Conditions: Temperature; 25 degree centigrade; Humidity: 65%;

Output Image: 5% Chart;

Lubricant: Bar state lubricant block shown in FIG. 1;

Material of LUBRICANT: (1) Zinc Stearate, (2) Boron Nitride, (3) Mixture of Stearate and Boron Nitride;

Evaluation Manner: Friction Coefficient between Image bearer and Transfer member is measure by Euler belt method;

The result is shown in table 1 of FIG. 11.

The first table is illustrated in FIG. 11.

From the table 1, the below described matter can be understood. When a lubricant only comprised of zinc stearate is used, a friction coefficient largely increases after 1000 sheets are printed out. When a lubricant only comprised of boron nitride is used, a change in a friction coefficient from an initial stage to a time when 1000 sheets are printed out is small. When a lubricant comprised of mixture of zinc stearate and boron nitride is used, a change in a friction coefficient from an initial stage to a time when 1000 sheets are printed out is large in comparison with a case when that only comprised of the boron nitride is used.

However, a friction coefficient after printing out is smaller in comparison with a case when that only comprised of the boron nitride is used. In this respect, it is understood that a lubricant including mixture of the zinc stearate and the boron nitride is most preferably used.

Hence, an image forming apparatus that supplies lubricant to an image bearer including a photoconductive member is described. However, lubricant can be similarly supplied to an image bearer serving as an intermediate transfer member, on which a toner image is transferred from a photoconductive member. In this way, the image bearer includes the intermediate transfer member on which a toner image is formed beside the photoconductive member.

Further, it is well known that a process cartridge configured by at least integrating an image bearer, on which a toner image is formed, with a lubricant supplying device that supplies a lubricant to the surface of the image bearer, is detachably mounted to an image forming apparatus body. Thus, the above-mentioned configuration can be applied to the process cartridge. Specifically, a lubricant at least including composition of the boron nitride and the fatty acid metallic salt is used and supplied to the image bearer of the process cartridge. Then, a membrane forming device is arranged in the process cartridge to frictionally apply a lubricant supplied thereto to form a lubricant membrane on the surface of the image bearer. Then, a lubricant supplying device is controlled to always or intermittently supply the lubricant to the surface of the image bearer during the rotation of the image bearer.

Numerous additional modifications and variations of the present invention are possible in light of the above teachings. It is therefore to be understood that within the scope of the appended claims, the present invention may be practiced otherwise that as specifically described herein.

What is claimed is:

1. An image forming apparatus, comprising:

an image bearer configured to carry a toner image; and a lubricant supplying device configured to supply lubricant to a surface of the image bearer;

wherein said lubricant only includes a mixture of boron nitride and fatty acid metallic salt, the lubricant includes from 10 to 80 percent volume of the boron nitride, and the boron nitride has a lamellar structure.

2. The image forming apparatus as claimed in claim 1, further comprising a membrane forming device configured to frictionally apply the lubricant to the surface of the image bearer and form a lubricant membrane on the surface.

3. The image forming apparatus as claimed in any one of claims 1 and 2, wherein said lubricant supplying device at least intermittently supplies the lubricant when the image bearer rotates.

4. The image forming apparatus as claimed in claim 2, wherein the membrane forming device includes a first cleaning blade positioned downstream from the lubricant supplying device, and the image forming apparatus includes a second cleaning blade positioned upstream from the lubricant supplying device.

5. The image forming apparatus as claimed in claim 1, further comprising:

an elastic roller configured to frictionally apply the lubricant to the surface of the image bearer and form a lubricant membrane on the surface, wherein the elastic roller is positioned downstream from the lubricant supplying device between a discharge roller and a developing device.

6. The image forming apparatus as claimed in claim 1, wherein the boron nitride is a hexagonal system low pressure phase boron nitride.

7. A process cartridge detachable from an image forming apparatus body, comprising:

an image bearer configured to allow formation of a toner image; and a lubricant supplying device configured to supply lubricant to a surface of the image bearer;

wherein said lubricant only includes a mixture of boron nitride and fatty acid metallic salt, the lubricant includes from 10 to 80 percent volume of the boron nitride, and the boron nitride has a lamellar structure.

8. The process cartridge as claimed in claim 7, further comprising a membrane forming device configured to frictionally apply the lubricant and form a lubricant membrane on the surface of the image bearer.

9. The process cartridge as claimed in any one of claims 7 and 8, wherein said lubricant supplying device at least intermittently supplies the lubricant when the image bearer rotates.

10. The process cartridge as claimed in claim 8, wherein the membrane forming device includes a first cleaning blade positioned downstream from the lubricant supplying device, and the process cartridge includes a second cleaning blade positioned upstream from the lubricant supplying device.

11. The process cartridge as claimed in claim 9, further comprising:

an elastic roller configured to frictionally apply the lubricant to the surface of the image bearer and form a lubricant membrane on the surface, wherein the elastic roller is positioned downstream from the lubricant supplying device between a discharge roller and a developing device.

12. The process cartridge as claimed in claim 7, wherein the boron nitride is a hexagonal system low pressure phase boron nitride.

13. A lubricant, comprising:

a mixture of boron nitride and fatty acid metallic salt, wherein the lubricant includes from 10 to 80 percent volume of the boron nitride, the lubricant only includes the mixture of the boron nitride and the fatty acid metallic salt, and the boron nitride has a lamellar structure.

14. The lubricant as claimed in claim 13, wherein the boron nitride is a hexagonal system low pressure phase boron nitride.

15. The lubricant as claimed in claim 13, wherein the fatty acid metallic salt has a lamella crystal structure.

16. The lubricant as claimed in claim 13, wherein the lubricant is a solid state bar.

17. The lubricant as claimed in claim 13, wherein the lubricant is a powder.

* * * * *